US009483016B2

(12) United States Patent
Kashiide et al.

(10) Patent No.: US 9,483,016 B2
(45) Date of Patent: Nov. 1, 2016

(54) PHOTOSENSITIVE DRUM AND PROCESS CARTRIDGE

(75) Inventors: Yosuke Kashiide, Kunitachi (JP); Yukio Kubo, Kawasaki (JP); Makoto Nishigaki, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 482 days.

(21) Appl. No.: 13/237,014

(22) Filed: Sep. 20, 2011

(65) Prior Publication Data

US 2012/0076538 A1 Mar. 29, 2012

(30) Foreign Application Priority Data

Sep. 24, 2010 (JP) ..... 2010-214012
Aug. 18, 2011 (JP) ..... 2011-178801

(51) Int. Cl.
*G03G 21/16* (2006.01)
*G03G 15/00* (2006.01)
*G03G 21/18* (2006.01)

(52) U.S. Cl.
CPC ..... *G03G 21/1671* (2013.01); *G03G 15/757* (2013.01); *G03G 21/1821* (2013.01)

(58) Field of Classification Search
CPC ..... G03G 21/1857; G03G 2221/1657; G03G 21/1864; G03G 21/186; G03G 21/1647; G03G 15/757
USPC ..... 399/159, 167
See application file for complete search history.

(56) References Cited

U.S. PATENT DOCUMENTS 4,527,883 A * 7/1985 Kamiyama ..... G03G 15/751 248/544
5,953,562 A 9/1999 Kawaguchi et al.
2003/0156868 A1* 8/2003 Shin ..... G03G 21/0088 399/348
2005/0191092 A1* 9/2005 Toso et al. ..... 399/167
2007/0104510 A1* 5/2007 Kawai ..... F16D 1/101 399/167

FOREIGN PATENT DOCUMENTS

JP 08-248826 A 9/1996
JP 08-339151 A 12/1996
JP 2002-189384 A 7/2002
JP 2011-059507 A 3/2011
WO 2011/030840 A1 3/2011

* cited by examiner

*Primary Examiner* — David Gray
*Assistant Examiner* — Sevan A Aydin
(74) *Attorney, Agent, or Firm* — Fitzpatrick, Cella, Harper & Scinto

(57) ABSTRACT

A photosensitive drum for use with an image forming apparatus includes a cylinder, having a photosensitive layer at its surface, to which process units are contacted, a supporting shaft extending through the cylinder, and a flange provided at a longitudinal end portion of the cylinder. The flange includes a supporting portion supporting an inner peripheral portion of the cylinder within a contact area at which the process units contact the cylinder, and a first supported portion supported by the supporting shaft, with the first supported portion disposed further from the longitudinal end portion of the cylinder than the supporting portion. In addition, a second supported portion is supported by the supporting shaft and is disposed closer to the longitudinal end portion of the cylinder than the supporting portion. A clearance portion is provided between the first supported portion and the second supported portion with respect to a longitudinal direction of the cylinder.

12 Claims, 11 Drawing Sheets

(a)

(b)

PHOTOSENSITIVE DRUM AND PROCESS CARTRIDGE

FIELD OF THE INVENTION AND RELATED ART

The present invention relates to a photosensitive drum for use with an image forming apparatus of an electrophotographic type, such as a copying machine or a printer and relates to a process cartridge including the photosensitive drum.

The photosensitive drum has been constituted by a cylinder having a photosensitive layer at its surface and a flange provided at longitudinal end portions of the cylinder. The flange is supported by a supporting shaft provided on a cartridge frame or the like, so that the photosensitive drum is supported rotatably by the cartridge frame or the like. To the photosensitive drum, process means such as a charging means, a developing means, a transfer means and a cleaning means are contacted with predetermined pressure (Japanese Laid-Open Patent Application Hei 08-339151).

In recent years, for use in various environments, a further downsized image forming apparatus has been desired. For that reason, constituent parts used in the image forming apparatus have been required to be downsized. However, the photosensitive drum is, by a decrease in its outer diameter, liable to cause flexure when it receives a load, so that there was a possibility that a contact state between the photosensitive drum and the process means became non-uniform with respect to a longitudinal direction by the flexure. For that reason, a longitudinal contour of a charging roller or the like as the process means is formed in a crown-like shape or a means for enhancing rigidity of the photosensitive drum by increasing a thickness of the cylinder of the photosensitive drum, so that the influence on image formation is prevented. However, such a means causes a complicated shape of parts and an increase in cost, so that an improvement has been desired.

SUMMARY OF THE INVENTION

A principal object of the present invention is to provide a photosensitive drum, capable of meeting downsizing of a process cartridge and an image forming apparatus, which permits stable image formation with a simple constitution and has a good assembling property.

Another object of the present invention is to provide the process cartridge including the photosensitive drum.

According to an aspect of the present invention, there is provided a photosensitive drum for use with an image forming apparatus, comprising:

a cylinder, having a photosensitive layer at its surface, to which process means is contacted; and a flange provided at a longitudinal end portion of the cylinder, wherein the flange includes, in a contact area in which the process means contacts the cylinder, a supporting portion supporting an inner peripheral portion of the cylinder, a portion to be supported for being supported inside the cylinder by a supporting shaft for supporting the photosensitive drum, and a clearance portion which is provided in a region closer to a longitudinal end of the cylinder than the portion to be supported and which is out of contact with the supporting shaft, wherein the portion to be supported is provided at a position in which the portion to be supported overlaps with the supporting portion with respect to a longitudinal direction of the cylinder as seen in a diameter direction of the cylinder, and wherein the clearance portion extends from the contact area to an area outside the contact area.

According to another aspect of the present invention, there is provided a photosensitive drum for use with an image forming apparatus, comprising:

a cylinder, having a photosensitive layer at its surface, to which process means is contacted; and a flange provided at a longitudinal end portion of the cylinder, wherein the flange includes, in a contact area in which the process means contacts the cylinder, a supporting portion supporting an inner peripheral portion of the cylinder, a first portion to be supported for being supported inside the cylinder by a supporting shaft for supporting the photosensitive drum, a clearance portion which is provided in a region closer to a longitudinal end of the cylinder than the portion to be supported and which is out of contact with the supporting shaft, an a second portion to be supported, which is provided closer to the longitudinal end of the cylinder, for being supported by the supporting shaft, and wherein the supporting portion is provided between the first portion to be supported and the second portion to be supported with respect to the longitudinal direction as seen in a diameter direction of the cylinder.

According to another aspect of the present invention, there is provided a photosensitive drum for use with an image forming apparatus, comprising:

a cylinder, having a photosensitive layer at its surface, to which process means is contacted; and a flange provided at a longitudinal end portion of the cylinder, wherein the flange includes a portion to be supported for being supported inside the cylinder by a supporting shaft for supporting the photosensitive drum, and a supporting portion supporting an inner peripheral portion of the cylinder in a contact area in which the process means contacts the cylinder, and wherein the supporting portion is placed in a state in which the supporting portion supports the inner peripheral portion of the cylinder by supporting the photosensitive drum by the supporting shaft.

According to another aspect of the present invention, there is provided a process cartridge detachably mountable to an image forming apparatus, comprising:

(i) a frame including a supporting shaft;

(ii) a process means; and (iii) a photosensitive drum including:

a cylinder, having a photosensitive layer at its surface, to which process means is contacted; and a flange provided a longitudinal end portion of the cylinder, wherein the flange includes, in a contact area in which the process means contacts the cylinder, a supporting portion supporting an inner peripheral portion of the cylinder, a portion to be supported for being supported inside the cylinder by the supporting shaft, and a clearance portion which is provided in a region closer to a longitudinal end of the cylinder than the portion to be supported and which is out of contact with the supporting shaft, wherein the portion to be supported is provided at a position in which the portion to be supported overlaps with the supporting portion with respect to a longitudinal direction of the cylinder as seen in a diameter direction of the cylinder, and wherein the clearance portion extends from the contact area to an area outside the contact area.

According to another aspect of the present invention, there is provided a process cartridge detachably mountable to an image forming apparatus, comprising:

(i) a frame including a supporting shaft;

(ii) a process means; and (iii) a photosensitive drum including:

a cylinder, having a photosensitive layer at its surface, to which process means is contacted; and a flange provided at a longitudinal end portion of the cylinder, wherein the flange includes, in a contact area in which the process means contacts the cylinder, a supporting portion supporting an inner peripheral portion of the cylinder, a first portion to be supported for being supported inside the cylinder by the supporting shaft, a clearance portion which is provided in a region closer to a longitudinal end of the cylinder than the portion to be supported and which is out of contact with the supporting shaft, an a second portion to be supported, which is provided closer to the longitudinal end of the cylinder, for being supported by the supporting shaft, and wherein the supporting portion is provided between the first portion to be supported and the second portion to be supported with respect to the longitudinal direction as seen in a diameter direction of the cylinder.

According to a further aspect of the present invention, there is provided a process cartridge detachably mountable to an image forming apparatus, comprising:

(i) a frame including a supporting shaft;

(ii) a process means; and (iii) a photosensitive drum including:

a cylinder, having a photosensitive layer at its surface, to which process means is contacted; and a flange provided at a longitudinal end portion of the cylinder, wherein the flange includes a portion to be supported for being supported inside the cylinder by the supporting shaft, and a supporting portion supporting an inner peripheral portion of the cylinder in a contact area in which the process means contacts the cylinder, and wherein the supporting portion is placed in a state in which the supporting portion supports the inner peripheral portion of the cylinder by supporting the photosensitive drum by the supporting shaft.

These and other objects, features and advantages of the present invention will become more apparent upon a consideration of the following description of the preferred embodiments of the present invention taken in conjunction with the accompanying drawings.

Figure 8:
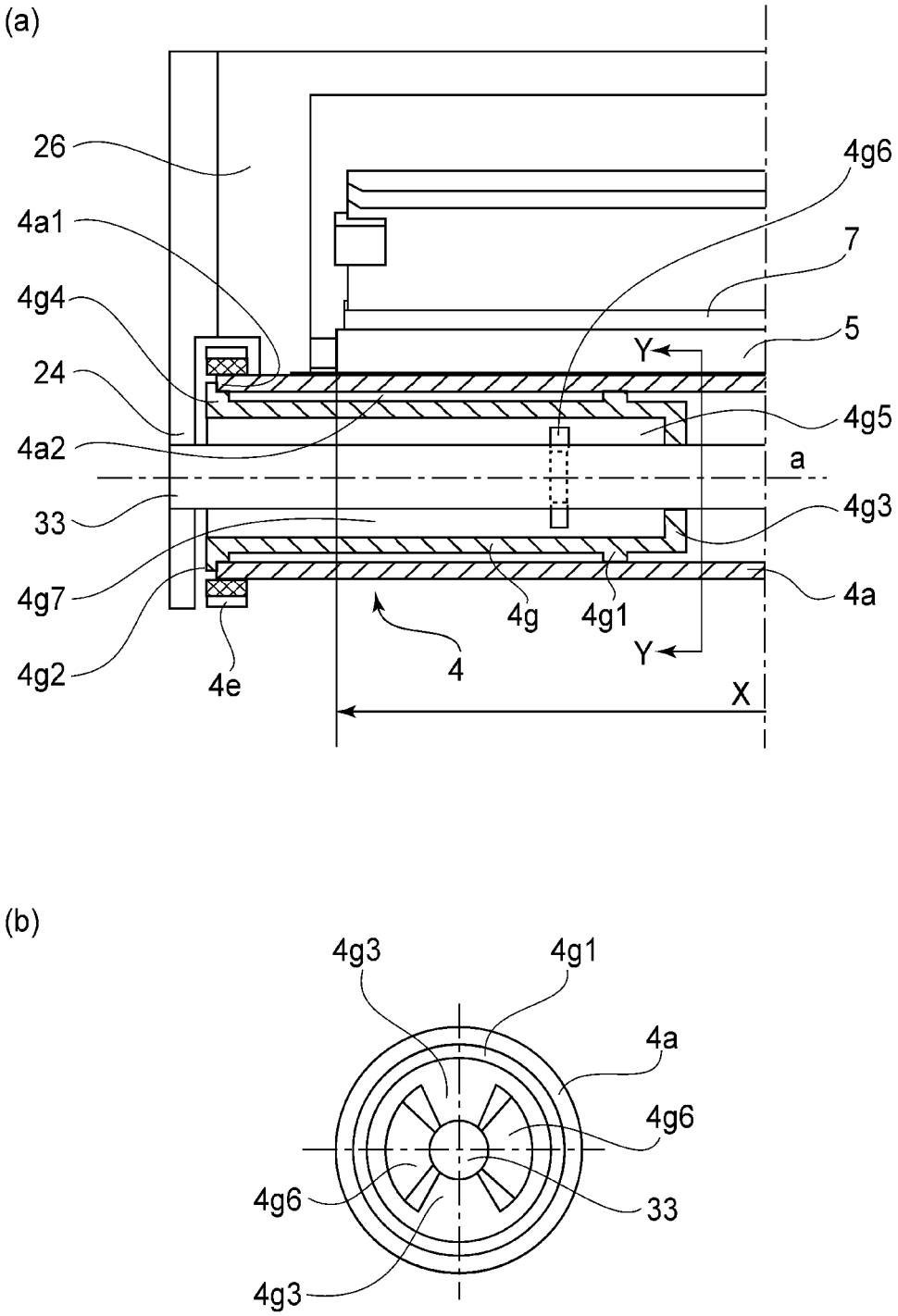

Parts (a) and (b) of FIG. 8 are sectional views showing a supporting structure of a photosensitive drum in Third Embodiment.

Figure 9:
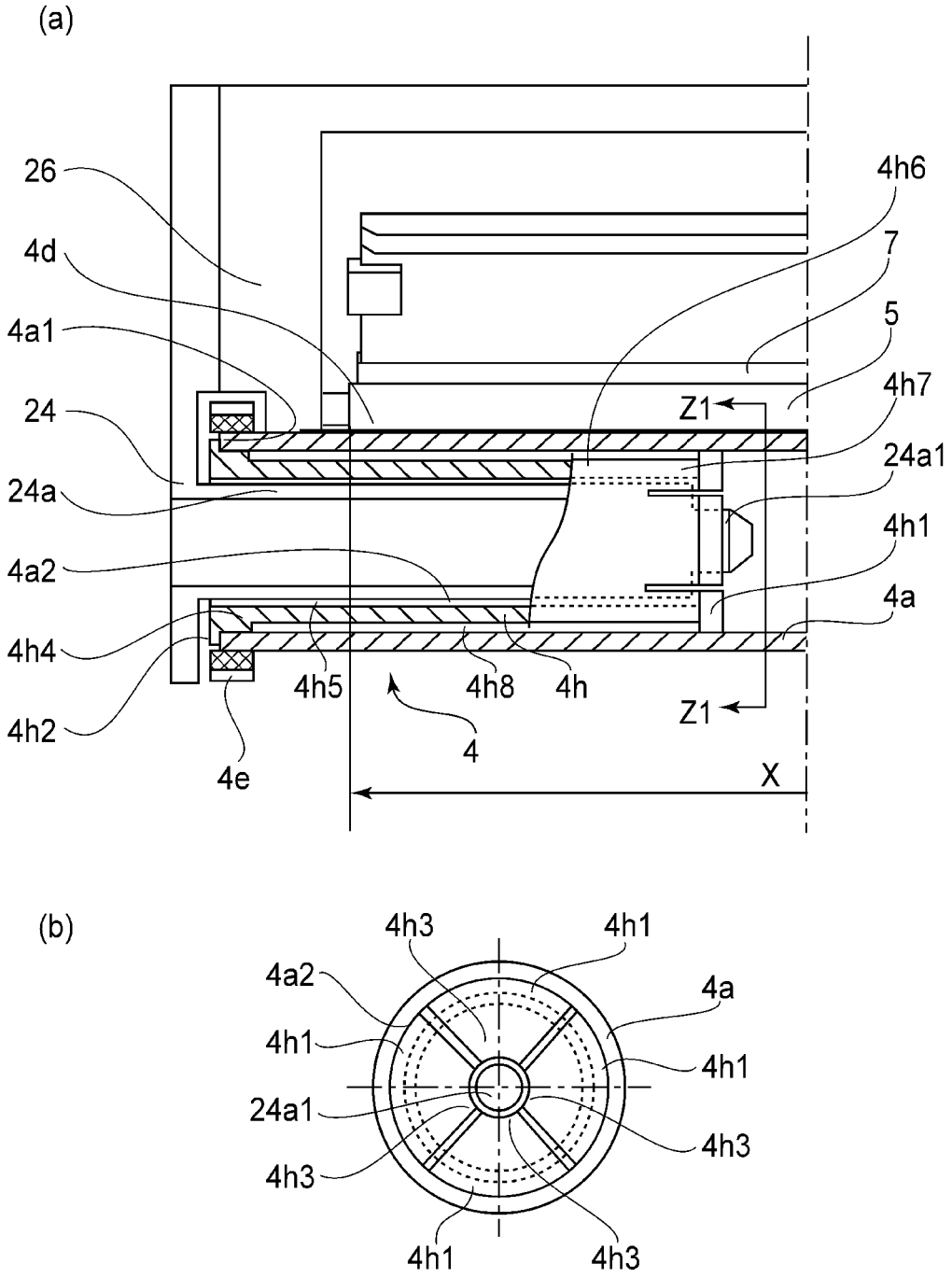
Figure 10:
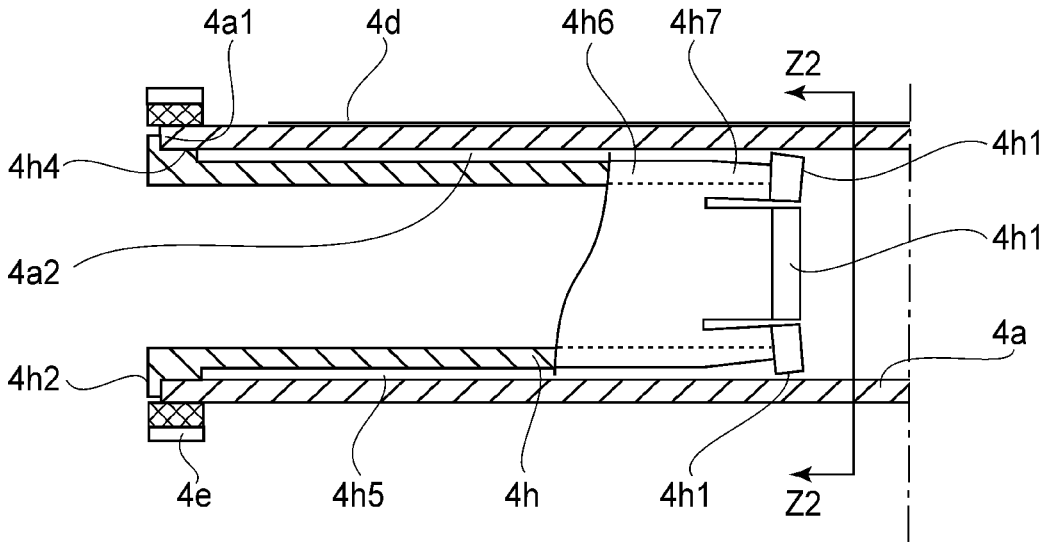
Figure 10:
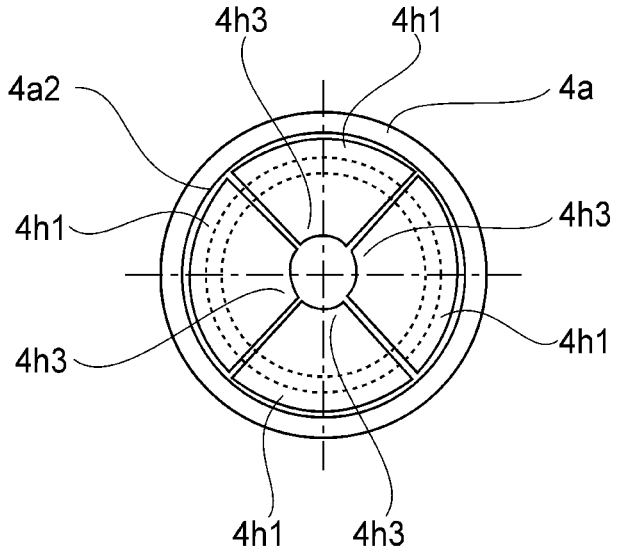

Parts (a) and (b) of FIG. 9, and (a) and (b) of FIG. 10 are sectional views showing a supporting structure of a photosensitive drum in Fourth Embodiment.

Figure 11:
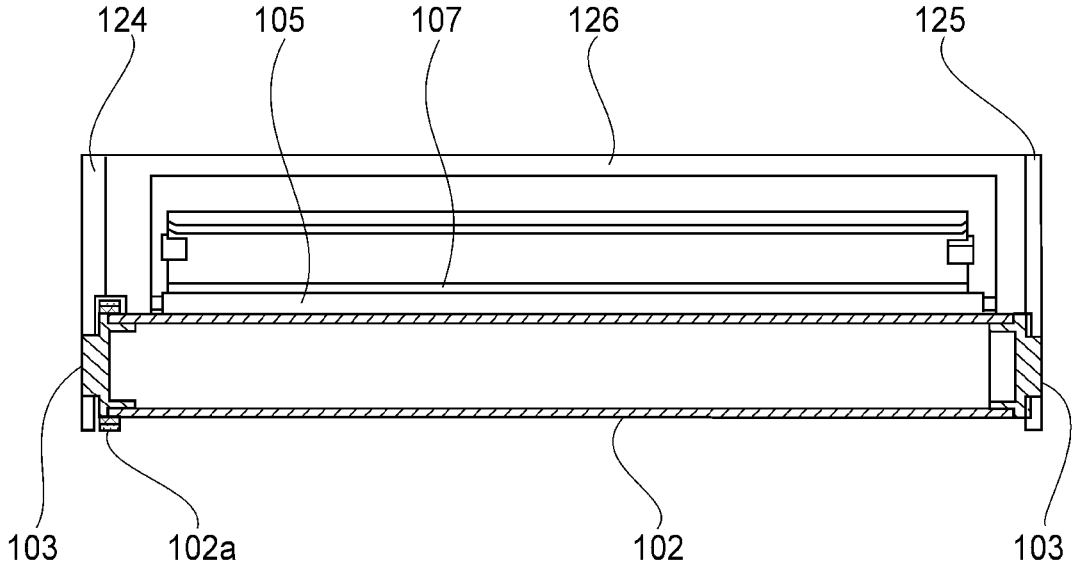

FIG. 11 is a sectional view showing a supporting structure of a photosensitive drum in Comparative Embodiment.

DESCRIPTION OF THE PREFERRED EMBODIMENTS

[First Embodiment]

Figure 2:
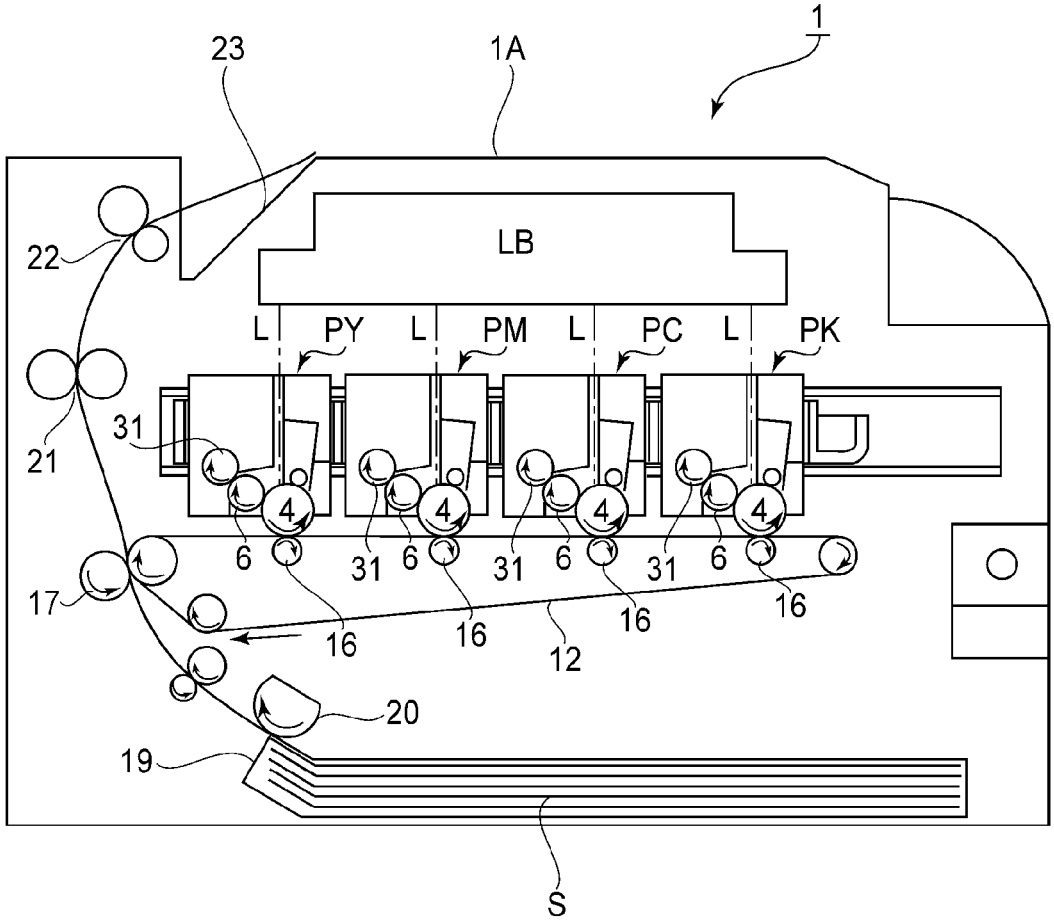
FIG. 2 is a structural view of an image forming apparatus in First Embodiment.
Figure 3:
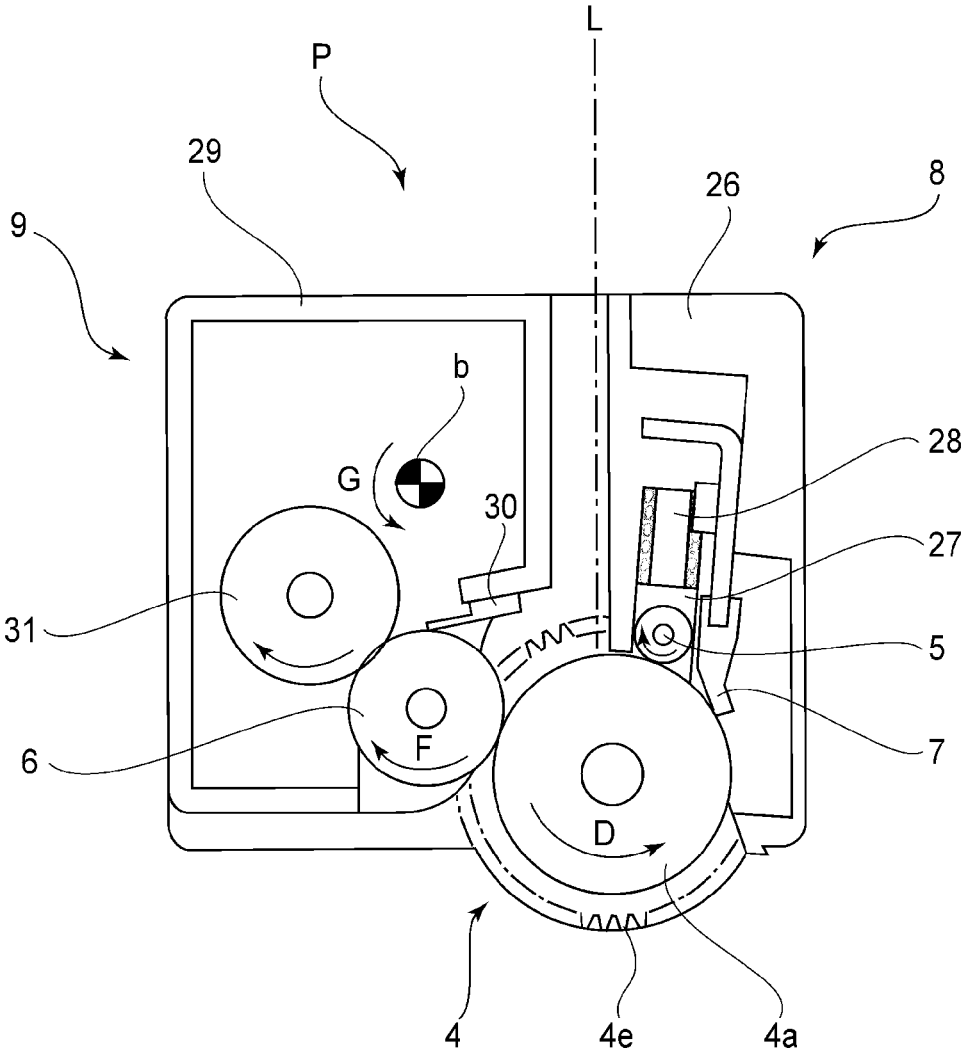
FIG. 3 is a structural view of a process cartridge in First Embodiment.

A supporting structure of a photosensitive drum in this embodiment will be described with reference to the drawings. FIG. 2 is a structural view of an image forming apparatus 1 in this embodiment. FIG. 3 is a structural view of a process cartridge P in this embodiment. As shown in FIG. 2, an apparatus main assembly 1A of the image forming apparatus 1 includes a laser scanner unit LB, four process cartridges P (PY, PM, PC and PK) and an intermediary transfer belt 12. The process cartridges P are detachably mountable to the apparatus main assembly 1A of the image forming apparatus 1.

As shown in FIG. 3, each process cartridge P includes a cleaning unit 8 and a developing unit 9. The cleaning unit 8 includes a photosensitive drum 4, a charging roller (charging means) 5, a cleaning blade (cleaning means) 7 and a cleaner container 26. A drum unit includes the photosensitive drum 4 and a drive input gear (drum drive input portion) 4*e*.

The developing unit 9 includes a developing roller (developing means) 6, a developing container 29, a developing blade 30 and a developer supplying roller 31. The charging roller 5, the developing roller 6 and the cleaning blade 7 are the process means acting on the photosensitive drum 4. The photosensitive drum 4 includes a cylindrical member (cylinder) 4*a* and a photosensitive layer 4*d* at a surface of the cylinder 4*a*. The process means contacts the surface of the photosensitive drum with predetermined pressure. The charging roller 5 is rotatably supported by a bearing 27 of the cleaner container as a frame and is urged against the photosensitive drum 4 by an urging spring 28. The cleaning blade 7 is fixed on the cleaner container 27 and is provided so that an end of an elastic rubber portion is contacted to the photosensitive drum 4 counterdirectionally with a rotational direction of the photosensitive drum 4. The developer supplying roller 31 supplies a developer from the developing container to the developing roller 6, so that the developer is carried on the developing roller 6. The developing blade 30 contacts the developing roller 6 counterdirectionally with a rotational direction of the developing roller 6 at its end, so that the developing blade 30 regulates a toner in a thin layer at a peripheral surface of the developing roller 6.

Figure 4:
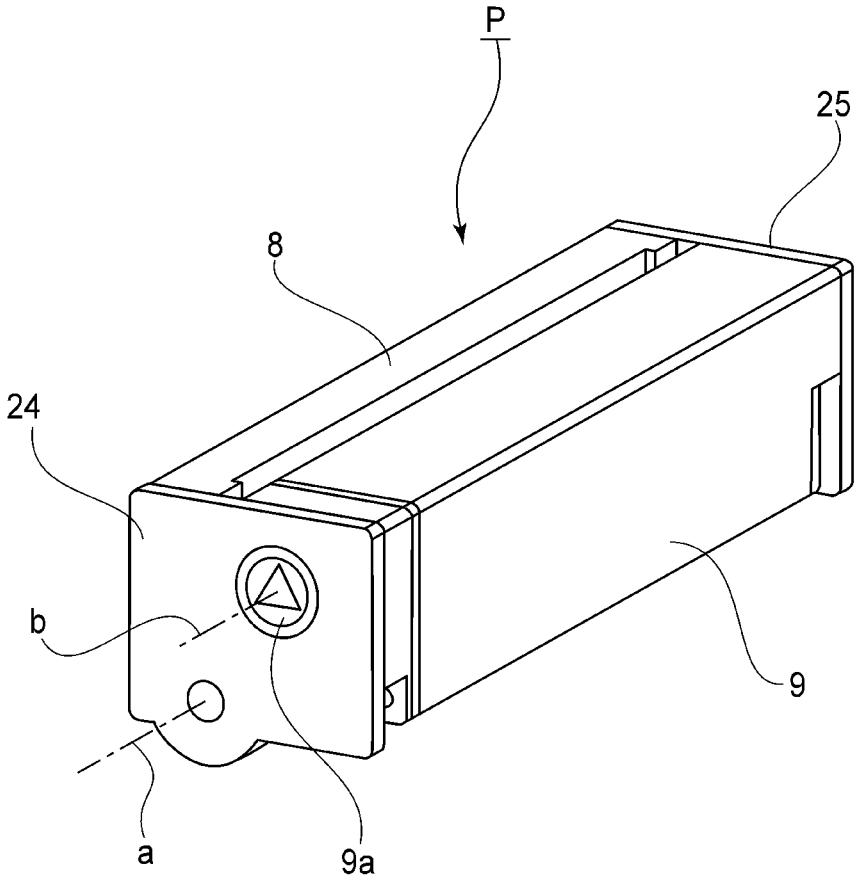
FIG. 4 is a perspective view of the process cartridge in First Embodiment.

As shown in FIG. 4, each process cartridge P has an elongated shape such that the longitudinal direction thereof is a direction of a rotational axis (center axis, drum axis) a of the photosensitive drum 4. Each process cartridge P includes a drive-side cover member 24 and a non-drive-side cover member 25. The developing unit 9 is supported by the drive-side cover member 24 and the non-drive-side cover member 25 so as to be swingable about an axis b parallel to the drum axis a.

As shown in FIG. 3, the developing unit 9 is always urged by an urging spring (not shown) in a direction (arrow G direction or counterclockwise direction in FIG. 3) in which the developing roller 6 contacts the photosensitive drum 4, so that the developing roller 6 contacts the photosensitive drum 4. The photosensitive drum 4 is rotatably supported by the drive-side cover member 24 and the non-drive-side cover member 25 and is rotationally driven by obtaining a driving force of a motor (not shown) of the apparatus main assembly form a drive input gear 40 (arrow D direction or counterclockwise direction in FIG. 3). The developing roller 6 is rotationally driven by obtaining the driving force of a motor (not shown) of the apparatus main assembly from a developing device drive input portion 9*a* (arrow F direction or clockwise direction in FIG. 3).

As shown in FIGS. 2 and 3, in each process cartridge P, the charging roller 5 uniformly charges the surface of the photosensitive drum 4 to predetermined potential and polarity. The charged photosensitive drum 4 is subjected to scanning exposure with laser light L, depending on an image signal for each color, emitted from a laser scanner unit LB, so that an electrostatic latent image is formed. The electrostatic latent image is developed with a toner, for each of colors of yellow, cyan, magenta and black, into a toner image. The resultant color toner images formed on the photosensitive drum 4 are primary-transferred superposedly onto the intermediary transfer belt 12 by a primary transfer roller 16.

A sheet S accommodated in a feeding tray 19 is fed and conveyed to a secondary transfer portion which is a nip between a secondary transfer roller 17 and the intermediary transfer belt 12 by a feeding roller 20, so that the toner images are secondary-transferred onto the sheet S. The sheet S is heated and pressed by a fixing device 21 and thus the toner images are fixed on the sheet S. Thereafter, the sheet S is discharged on a discharge tray 23 by a discharging roller 22.

After the primary transfer, transfer residual toner remaining on the photosensitive drum 4 is scraped off by the cleaning blade 7, so that the surface of the photosensitive drum 4 is cleaned. The scraped transfer residual toner is accommodated as a residual toner in a residual toner accommodating portion of the cleaner container 26.

(Photosensitive Drum)

Figure 1:
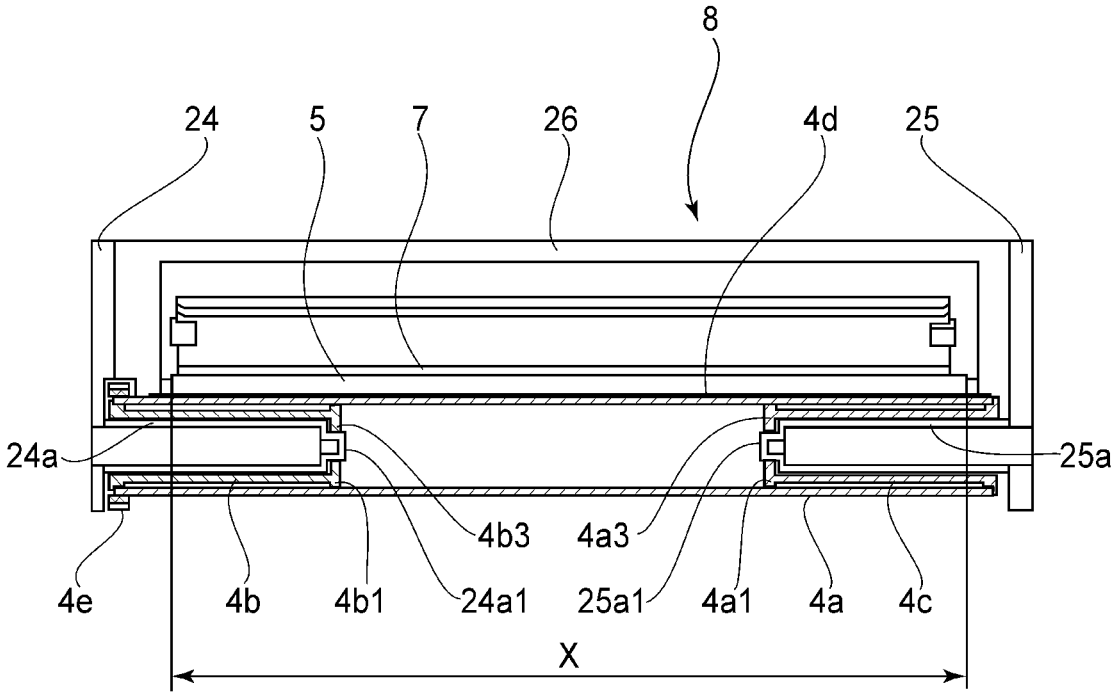
FIG. 1 is a sectional view showing a supporting structure of a photosensitive drum in First Embodiment.

FIG. 1 is a sectional view showing a supporting structure of the photosensitive drum 4 in this embodiment. As shown in FIG. 1, stepped cylindrical flange members 4*b* and 4*c* are provided at longitudinal end portions of the cylinder 4*a* of the photosensitive drum 4 (in the axial direction of the photosensitive drum 4). These flange members 4*b* and 4*c* have the substantially same shape and therefore in the following, a constitution of the flange member will be described by taking the flange member 4*b* as an example.

The flange member 4*b* includes a drum supporting portion 4*b*1 protruded in a radial direction to contact a longitudinal central portion of the cylinder 4*a*. The drum supporting portion 4*b*1 contacts an inner peripheral portion 4*a*2 of the cylinder 4*a* to support the photosensitive drum 4. Further, the drum supporting portion 4*b*1 contacts the inner peripheral portion 4*a*2 in a contact area X in which the process means contacts the surface photosensitive layer 4*d* of the cylinder 4*a* with respect to the longitudinal direction of the photosensitive drum 4. By constituting the photosensitive drum 4 in such a manner, it is possible to suppress flexure of the photosensitive drum 4 although details will be described later, so that a supporting accuracy of the photosensitive drum 4 is improved.

Figure 5:
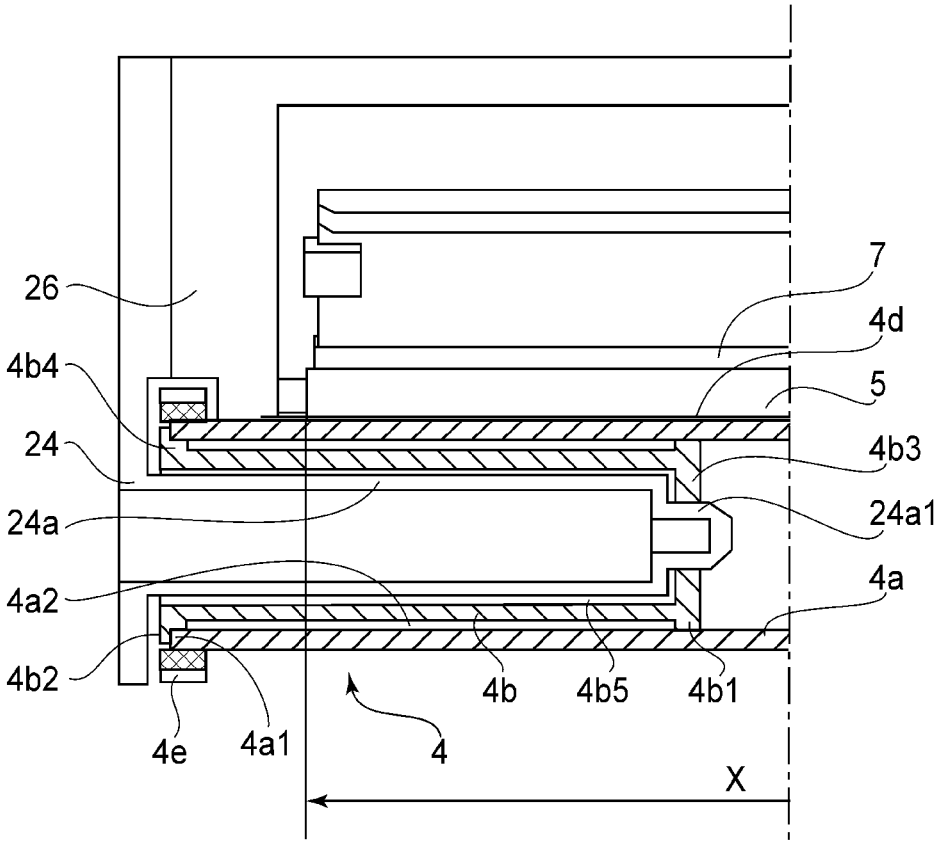
FIG. 5 is a sectional view showing the supporting structure of the photosensitive drum in First Embodiment.

Further, as shown in FIG. 5, the flange member 4*b* includes a regulating portion 4*b*2 radially protruded at a longitudinal end side of the cylinder 4*a*. The regulating portion 4*b*2 contacts an end surface 4*a*1 of the cylinder 4*a*, so that a position of the flange member 4*b* relative to the cylinder 4*a* with respect to the drum axis direction (longitudinal direction) is regulated. Further, at an opposing longitudinal end side of the cylinder 4*a*, the flange member 4*b* includes, another (second) drum supporting portion 4*b*4 which is radially protruded. The drum supporting portion 4*b*4 also contacts the inner peripheral portion 4*a*2 of the cylinder 4*a* to support the photosensitive drum 4. Further, in this embodiment, the drum supporting portion 4*b*4 contacts the inner peripheral portion 4*a*2 of the cylinder 4*a* in an area outside the contact area X.

The flange member 4*b* further includes a portion to be supported 4*b*3 engaged with and supported by an end portion 24*a*1 of a drum supporting shaft 24*a* provided on the cover member 24. The portion to be supported 4*b*3 is provided at a position in which it overlaps with the drum supporting portion 4*b*1 as seen in a diameter direction (perpendicular to the develop) of the cylinder 4*a* with respect to the longitudinal direction of the cylinder 4*a*. By employing such a constitution, a position in which the flange member 4*b* receives a load from the cylinder 4*a* with respect to the longitudinal direction coincides with a position in which the drum supporting shaft 24*a* receives the load from the flange member 4*b*. For that reason, the flexure of the photosensitive drum 4 is suppressed and thus the supporting accuracy of the photosensitive drum 4 is improved. Further, with respect to the longitudinal direction of the cylinder 4*a*, at a side closer to the end of the cylinder 4*a* than the portion to be supported 4*b*3, a clearance portion 4*b*5 is provided to the flange member 4*b* so as to create a gap (clearance) between the flange member 4*b* and the drum supporting shaft 24*a*. This clearance portion 4*b*5 is, as shown in FIG. 5, provided so as to extend from the contact area X to the area outside the contact area X. By employing such a constitution, when the drum supporting shaft 24*a* is mounted in the photosensitive drum 4, the drum supporting shaft 24*a* can be smoothly inserted. Therefore, an assembling property such that the drum supporting shaft 24*a* is mounted in the photosensitive drum 4 is improved. Further, the flange member 4*b* is molded with a resin material. Therefore, in this constitution, by accurately controlling only dimensions of the drum supporting portions 4*b*1 and 4*b*4 and the portion to be supported 4*b*3, the photosensitive drum 4 supporting accuracy is improved. These effects are more prominent when the flange member 4*b* has such a shape that the flange member 4*b* is inserted into the cylinder 4*a* so as to be closer to a longitudinal center of the cylinder 4*a*. That is, even when a length of the flange member 4*b* is increased, the photosensitive drum 4 supporting accuracy can be improved by controlling a length of the flange member 4*b*, in which the flange member 4*b* is engaged with the drum supporting shaft 24*a* and the cylinder 4*a*, to be minimized.

(Comparative Embodiment)

FIG. 11 is a sectional view showing a supporting structure of the photosensitive drum in Comparative Embodiment. As shown in FIG. 11, in a conventional photosensitive drum supporting structure, flange members 103 support inner peripheral portions of a photosensitive drum 102 at longitudinal end portions of the photosensitive drum 102.

In such a constitution, when a diameter of the photosensitive drum 102 is decreased, by a contact pressure of the process means, a degree of flexure of the photosensitive drum 102 becomes large. When the degree of the flexure of the photosensitive drum 102 is increased, there is a possibility that a charging roller 105 cannot uniformly contact the photosensitive drum 102 with respect to the drum axis direction to cause image non-uniformity. For that reason, means for uniformizing a contact state between the photosensitive drum 102 and the charging roller 105 such that the charging roller 105 is formed in a crown-like shape or a thickness of the photosensitive drum 102 is increased to enhance rigidity of the photosensitive drum 102 were used. However, these means caused a complicated shape of the charging roller 105 and an increase in cost in some cases.

(Comparison Between Supporting Structure in Comparative Embodiment and Supporting Structure in Embodiment 1)

As shown in FIG. 1, in this embodiment (Embodiment 1), the drum supporting portion **4*b*1 contacts the inner peripheral portion 4*a*2 of the cylinder 4*a* in the contact area X in which the process means contacts the surface photosensitive layer 4*d* of the cylinder 4*a* with respect to the longitudinal direction of the photosensitive drum 4. Here, the flexure generated in the photosensitive drum 4 which is supported by the flange member 4*b*** and receives the contact pressure from the process means in the contact area X can be similarly considered as the case of flexure generated in a beam which receives a uniform load and is supported at two points. Generally, in the case of a both end supported beam which receives the uniform load as a whole, a longer full length, i.e., a larger distance between the two supporting points causes a larger degree of maximum flexure generated at a central portion between the two supporting points.

Flexure v generated in the photosensitive drum 102 in the supporting structure in Comparative Embodiment is represented by formula 1 shown below. Incidentally, in the following description, l represents the full length of the beam, I represents a geometrical moment of inertia, E represents Young's modulus and w represents a load per unit length.

$$v = \frac{5wl^4}{384EI} \quad \text{(Formula 1)}$$

On the other hand, the supporting structure in this embodiment can be considered as a both end projected beam such that the beam which receives the uniform load as a whole is supported inside the load. In this case, flexure $v_0$ generated at longitudinal end portions of the beam and flexure vm generated at a longitudinal central portion of the beam are represented by formula 2 and formula 3, respectively shown below. Incidentally, in the following, $l_1$ represents a distance from each end of the beam to the associated (close) supporting point and $l_2$ represents a distance between the two supporting points.

$$v_0 = \frac{wl_1}{24EI}(3l_1 + 6l_1^2 l_2 - l_2^3) \quad \text{(Formula 2)}$$

$$v_m = \frac{wl_2^2}{384EI}(5l_2^2 - 24l_1^2) \quad \text{(Formula 3)}$$

When $l=2l_1+l_2$, $l_1>0$ and $l>l_2$ are satisfied and thus from a comparison between formula 2 and formula 3, it is understood that v>vm is always satisfied. That is, the flexure vm of the both end projected beam, at the longitudinal central portion, which is the supporting structure in this embodiment is always smaller than the flexure v of the both end supported beam, at the longitudinal central portion, which is the supporting structure in Comparative Embodiment. Therefore, in this case, when the positions of the supporting points are determined so as to satisfy $v>v_0$, it is possible to reduce the degree of flexure generated in the beam compared with the case where the beam is supported at its longitudinal end portions.

Accordingly, also in the photosensitive drum 4, as in this embodiment, the drum supporting portion **4*b*1 is provided within the contact area X of the process means, so that the degree of flexure generated in the photosensitive drum 4 can be reduced compared with the case of Comparative Embodiment in which the beam is supported at the longitudinal end portions. Further, there is no need to use the means for forming the charging roller 105 in the crown-like shape and for enhancing rigidity of the photosensitive drum 102 by increasing the thickness of the photosensitive drum 102. For this reason, it is possible to meet the downsizing of the process cartridge and the image forming apparatus, so that the supporting structure for supporting the photosensitive drum capable of inexpensively forming a stable image can be provided. Further, as described above, the flange member 4*b* includes the portion to be supported 4*b*3 engaged with and supported by the drum supporting shaft 24*a* and includes the clearance portion 4*b*5 provided closer to the end of the flange member 4*b* than the portion to be supported 4*b*3. By this flange member 4*b*, even when the process means contacts the photosensitive drum 4, the degree of flexure of the photosensitive drum 4 can be reduced and thus it becomes possible to improve operativity when the drum supporting shaft 24*a* is assembled into the photosensitive drum 4**.

Figure 6:
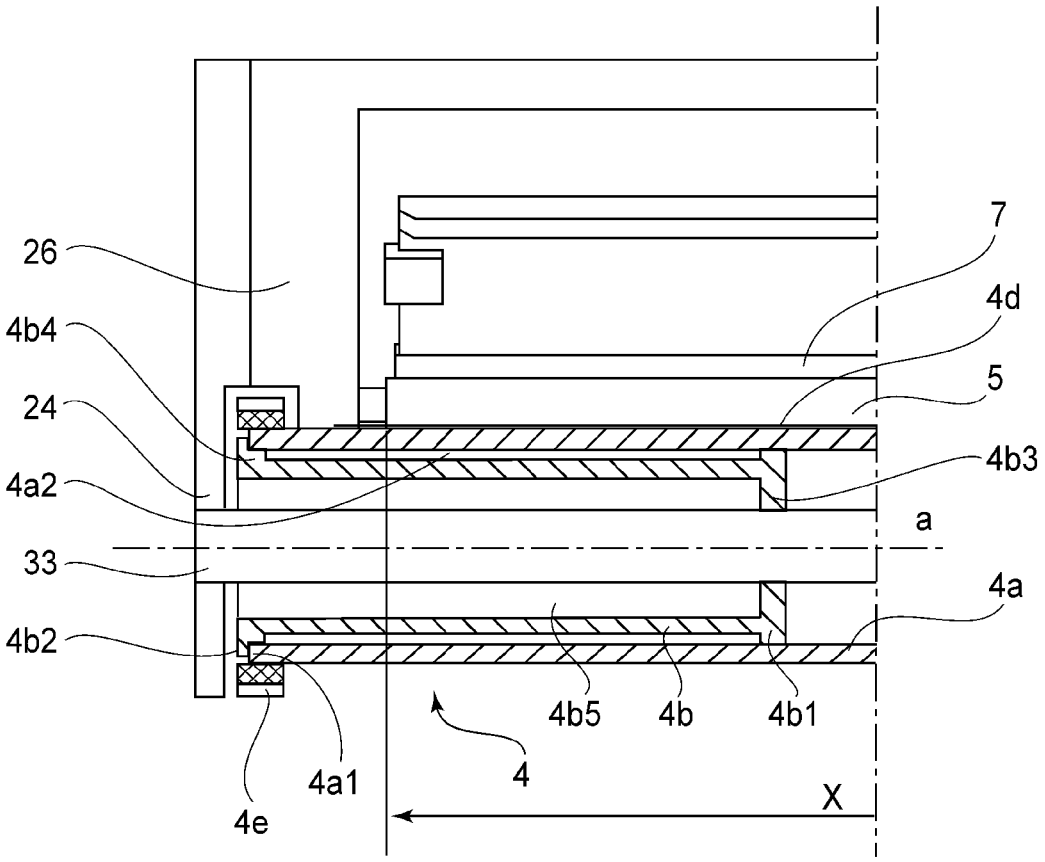
FIG. 6 is a sectional view showing a supporting structure of another photosensitive drum in First Embodiment.

Incidentally, other than the above-described supporting structure of the photosensitive drum 4, as shown in FIG. 6, in place of the drum supporting shaft **24*a*, a through (penetration) shaft 33, which passes through the cylinder 4*a* in the longitudinal direction and protrudes from longitudinal end portions of the cylinder 4*a* is provided. The through shaft 33 is supported at its longitudinal end portions by the cover members 24 and 25 which are fixed on the cleaner container 26**.

[Second Embodiment]

Figure 7:
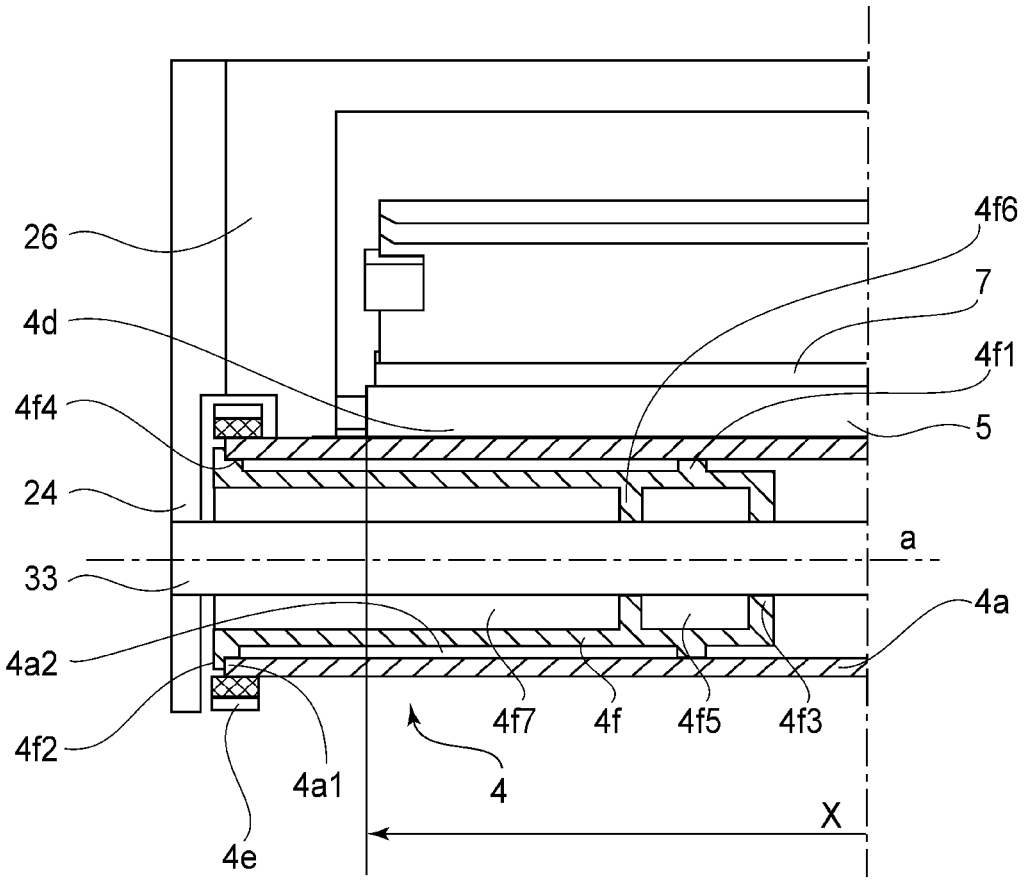
FIG. 7 is a sectional view showing a supporting structure of a photosensitive drum in Second Embodiment.

Next, a supporting structure for supporting a photosensitive drum in this embodiment will be described. Constituent members or portions identical to those in First Embodiment are represented by the same reference numerals or symbols and will be omitted from the description. FIG. 7 is a sectional view showing a supporting structure of the photosensitive drum in this embodiment.

In First Embodiment, with respect to the longitudinal direction, the constitution in which the portion to be supported **4*b*3 is provided at only one position relative to the drum supporting portion 4*b*1** is shown.

In this embodiment, with respect to the longitudinal direction, a flange member **4*f* is provided with a first portion to be supported 4*f*3 inside a drum supporting portion 4*f*1 and a second portion to be supported 4*f*6, outside the drum supporting portion 4*f*1, closer to the end of the flange member 4*f* than the first portion to be supported 4*f*3. Further, the shape of the first portion to be supported 4*f*3 and the second portion to be supported 4*f*6 is a hole. Further, with respect to the longitudinal direction, the drum supporting portion 4*f*1 is provided between the first portion to be supported 4f3 and the second portion to be supported 4*f*6 and contacts the inner peripheral portion 4*a*2 of the cylinder 4*a* in the contact area X similarly as in First Embodiment. Further, the first portion to be supported 4*f*3 and the second portion to be supported 4*f*6 also contact the through shaft 33** in the contact area X.

Also, in the above constitution, the flexure of the photosensitive drum 4 is suppressed and thus the supporting accuracy of the photosensitive drum 4 can be improved.

Further, with respect to the longitudinal direction of the cylinder 4*a*, between the first portion to be supported 4*f*3 and the second portion to be supported 4*f*6, a first clearance portion 4*f*5 is provided so as not to contact the through shaft 33. Further, with respect to the longitudinal direction, at a side closer to the end of the flange member 4*f* than the second portion to be supported 4*f*6, a second clearance portion 4*f*7 is provided so as not to contact the through shaft 33. The clearance portion 4*f*7 is, as shown in FIG. 7, provided so as to extend from the contact area X to the area outside the contact area X. Other constitutions are identical to those in First Embodiment. By employing such a constitution, when the through shaft 33 is mounted in the photosensitive drum 4, the through shaft 33 can be smoothly inserted. Therefore, an assembling property such that the through shaft 33 is mounted in the photosensitive drum 4 is improved. Further, similarly as in First Embodiment, the flange member 4*f* is molded with a resin material. Therefore, in this constitution, by accurately controlling only dimensions of the drum supporting portions 4*f*1 and 4*f*4 and the portions to be supported 4*f*3 and 4*f*6, the photosensitive drum 4 supporting accuracy is improved. These effects are more prominent when the flange member 4*f* has such a shape that the flange member 4*f* is inserted into the cylinder 4*a* so as to be closer to a longitudinal center of the cylinder 4*a*. That is, even when a length of the flange member 4*f* is increased, the photosensitive drum 4 supporting accuracy can be improved by controlling a length of the flange member 4*f*, in which the flange member 4*f* is engaged with the through shaft 33 and the cylinder 4*a*, to be minimized.

[Third Embodiment]

Next, a supporting structure for supporting a photosensitive drum in this embodiment will be described. Constituent members or portions identical to those in Second Embodiment are represented by the same reference numerals or symbols and will be omitted from the description. FIG. 8 is a sectional view showing a supporting structure of the photosensitive drum in this embodiment.

In the Second Embodiment, as shown in FIG. 7, the flange member 4*f* was provided with the first portion to be supported 4*f*3 and the second portion to be supported 4*f*6 which had the hole-like shape. However, in a constitution in that embodiment, when the flange member 4*f* is molded, the area of the clearance portion 4*f*5 has an undercut shape. For that reason, a metal mold used when the flange member 4*f* is molded is required to be moved in the diameter direction of the flange member 4*f*, so that the constitution of the metal mold is complicated. When the diameter of the flange member 4*f* becomes small, a space in which the metal mold is moved in the diameter direction of the flange member 4*f* is limited.

Therefore, in this embodiment, as shown in FIG. 8, a first portion to be supported 4*g*3 and a second portion to be supported 4*g*6 are provided at different positions with respect to a circumferential direction as seen in the longitudinal direction of the flange member 4*g* (in Y-Y direction in (a) of FIG. 8), as shown in (b) of FIG. 8. In this constitution, the area of a clearance portion 4*g*5 has not the undercut shape and thus there is no need to move the metal mold in the diameter direction of the flange member 4*g*. That is, in addition to the effect of Second Embodiment, an effect of facilitating the molding of the flange member 4*g* is achieved. Other effects are similar to those in Second Embodiment. In that regard, supporting positions 4*g*1 and 4*g*4 are similar to supporting positions 4*f*1 and 4*f*4, and regulating portion 4g2 is similar to regulating portion 4*f*2.

[Third Embodiment]

Next, a supporting structure for supporting a photosensitive drum in this embodiment will be described. Constituent members or portions identical to those in First Embodiment are represented by the same reference numerals or symbols and will be omitted from the description. FIGS. 9 and 10 are sectional views showing a supporting structure of the photosensitive drum in this embodiment. Here, (a) of FIG. 9 is a longitudinal sectional view showing a state in which the drum supporting shaft 24*a* is mounted in the photosensitive drum 4, and (b) of FIG. 9 is a schematic view of the photosensitive drum 4 as seen in the longitudinal direction of the photosensitive drum (in Z1-Z1 direction in (a) of FIG. 9). Further, (a) of FIG. 10 is a longitudinal sectional view showing the photosensitive drum 4 in a state in which the drum supporting shaft 24*a* is not yet mounted, and (b) of FIG. 10 is a schematic view of the photosensitive drum 4 as seen in the longitudinal direction of the photosensitive drum (in Z2-Z2 direction in (a) of FIG. 10).

A difference from First Embodiment is that a flange 4*h* is, as shown in FIGS. 9 and 10, a cylindrical base portion 4*h*6 and a plurality of arm portions (parts) 4*h*7 which are protruded from the base portion 4*h*6 along the longitudinal direction of the cylinder 4*a*. Further, each arm portion 4*h*7 includes, similarly as in First Embodiment, a drum supporting portion 4*h*1 for supporting the inner peripheral portion 4*a*2 of the cylinder 4*a* and a portion to be supported 4*h*3 to be engaged with and supported by the end 24*a*1 of the drum supporting shaft 24*a*. Further, at the longitudinal end side of the cylinder 4*a*, a portion to be supported 4*h*4 is press-fitted with the inner peripheral portion 4*a*2 of the cylinder 4*a*, so that the flange 4*h* is fixed to the cylinder 4*a*. Here, as shown in FIG. 10, in a state in which the drum supporting shaft 24*a* is not assembled, the arm portion 4*h*7 is in a state in which it is displaced, relative to the base portion 4*h*6, toward the center of the cylinder 4*a* with respect to a radial direction, i.e., in a bent state. That is, in the state in which the drum supporting shaft 24*a* is not assembled, there is a gap (clearance) between the drum supporting portion 4*h*1 and the inner peripheral portion 4*a*2 of the cylinder 4*a* and thus the drum supporting portion 4*h*1 does not support the inner peripheral portion 4*a*2 of the cylinder 4*a*. Further, as shown in FIG. 9, in the state in which the drum, the end portion 24*a*1 contacts the portion to be supported 4*h*3 as shown in (b) of FIG. 9, so that the arm portion 4*h*7 is outwardly displaced in the radial direction. Then, the drum supporting portion 4*h*1 is in a state in which it contacts the inner peripheral portion 4*a*2 of the cylinder 4*a*. That is, the drum supporting portion 4*h*1 is in a state in which it supports the inner peripheral portion 4*a*2 of the cylinder 4*a*.

By employing such a constitution, in addition to the assembling property of the drum supporting shaft 24*a* in the photosensitive drum 4, the operativity at the time when the drum supporting shaft 24*a* is mounted into the photosensitive drum 4 is also improved. That is, when the flange 4*h* is mounted in the cylinder 4*a*, the drum supporting portion 4*h*1 is in the bent state and therefore a sliding resistance with the cylinder 4*a* little occurs. Further, with respect to the longitudinal direction, between the drum supporting portion 4*h*1 and the portion to be supported 4*h*4, a clearance portion 4*h*8 which does not contact the inner peripheral portion 4*a*2 of the cylinder 4*a* is provided. Further, only when the portion to be supported 4*h*4 provided at the longitudinal end side of the cylinder 4*a* is press-fitted in the inner peripheral portion 4*a*2 of the cylinder 4*a*, the sliding resistance occurs between the flange 4*h* and the cylinder 4*a*. Therefore, also in this embodiment, the above-described effect is more prominent when the flange 4*h* enters the cylinder 4*a* and moves closer to the longitudinal center of the cylinder 4*a*. Further, when the flange 4*h* is constituted by a slidable resin material and the arm portion 4*h*7 is displaceable as described above, there is no particular problem even in a sliding state between the drum supporting shaft 24*a* and the portion to be supported 4*h*3. Other effects are similar to those in First Embodiment.

Further, in this embodiment, an example in which a cantilever supporting shaft such as the drum supporting shaft 24*a* provided with the end portion 24*a*1 is used is described but, it is also possible to use the through shaft as described in Second Embodiment.

As described above, according to the present invention, even when the process cartridge and the image forming apparatus are downsized, it is possible to obtain an effect such that the degree of flexure of the photosensitive drum due to the contact of the process means, that the image can be stably formed and that the operativity is improved when the photosensitive drum is assembled with the supporting shaft.

Further, according to the present invention, even when the process cartridge and the image forming apparatus are downsized, it is possible to obtain an effect such that the degree of flexure of the photosensitive drum due to the contact of the process means, that the image can be stably formed and that the operativity is improved when the flange is assembled with the cylinder.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 214012/2010 filed Sep. 24, 2010 and 178801/2011 filed Aug. 18, 2011, which is hereby incorporated by reference.

What is claimed is:

1. A photosensitive drum for use with an image forming apparatus, comprising:

a cylinder, having a photosensitive layer at its surface, to which process means is contacted;

a supporting shaft extending through said cylinder; and a flange provided at a longitudinal end portion of said cylinder, said flange having a radially inner side and a radially outer side, the radially inner side being disposed closer to said supporting shaft, wherein said flange includes:

a supporting projection disposed on the radially outer side of said flange and supporting an inner peripheral portion of said cylinder with a longitudinal region corresponding to a direct contact area at which the process means is in direct contact with said cylinder, a first supported projection disposed on the radially inner side of said flange and supported by said supporting shaft, said first supported projection disposed further from said longitudinal end portion of said cylinder than said supporting projection, a second supported projection disposed on the radially inner side of said flange and supported by said supporting shaft, said second supported projection disposed closer to said longitudinal end portion of said cylinder than said supporting projection, and a clearance provided between said first supported projection and said second supported projection with respect to a longitudinal direction of said cylinder, wherein with respect to the longitudinal direction of said cylinder, said supporting projection is provided at a position overlapping with said clearance, not overlapping with said first supported projection, and not overlapping with said second supported projection.

2. A drum according to claim 1, wherein said second supported projection is supported by said supporting shaft within the longitudinal region.

3. A drum according to claim 1, wherein said flange includes a regulating portion, in contact with said longitudinal end portion of said cylinder, to regulate a longitudinal position of said flange.

4. A drum according to claim 1, wherein said first supported projection and said second supported projection are provided at different positions with respect to a circumferential direction as seen in the longitudinal direction.

5. A drum according to claim 1, wherein said flange is provided at each of longitudinal end portions of said cylinder.

6. A drum according to claim 1, wherein the process means is any of a charging member for electrically charging said photosensitive drum, a developing member for forming a toner image on said photosensitive drum by supplying a toner to said photosensitive drum, and a cleaning member for removing the toner deposited on said photosensitive drum.

7. A process cartridge detachably mountable to an image forming apparatus, comprising:

(i) a frame including a supporting shaft;

(ii) process means; and (iii) a photosensitive drum including:

a cylinder, having a photosensitive layer at its surface, to which said process means is contacted;

a supporting shaft extending through said cylinder; and flange provided at a longitudinal end portion of said cylinder, said flange having a radially inner side and a radially outer side, the radially inner side being disposed closer to said supporting shaft, wherein said flange includes:

a supporting projection disposed on the radially outer side of said flange and supporting an inner peripheral portion of said cylinder within a longitudinal region corresponding to a direct contact area at which said process means is in direct contact with said cylinder, a first supported projection disposed on the radially inner side of said flange and supported by said supporting shaft, said first supported projection disposed further from said longitudinal end portion of said cylinder than said supporting projection, a second supported projection disposed on the radially inner side of said flange and supported by said supporting shaft, said second supported projection disposed closer to said longitudinal end portion of said cylinder than said supporting projection, and a clearance provided between said first supported projection and said second supported projection with respect to a longitudinal direction of said cylinder, and wherein with respect to the longitudinal direction of said cylinder, said supporting projection is provided at a position overlapping with said clearance, not overlapping with said first supported projection, and not overlapping with said second supported projection.

8. A cartridge according to claim 7, wherein said second supported projection is supported by said supporting shaft within the longitudinal region.

9. A cartridge according to claim 7, wherein said flange includes a regulating portion, in contact with said longitudinal end portion of said cylinder, to regulate a longitudinal position of said flange.

10. A cartridge according to claim 7, wherein said first supported projection and said second supported projection are provided at different positions with respect to a circumferential direction as seen in the longitudinal direction.

11. A cartridge according to claim 7, wherein said flange is provided at each of longitudinal end portions of said cylinder.

12. A cartridge according to claim 7, wherein said process means is any of a charging member for electrically charging said photosensitive drum, a developing member for forming a toner image on said photosensitive drum by supplying a toner to said photosensitive drum, and a cleaning member for removing the toner deposited on said photosensitive drum.

* * * * *